US009080132B2

(12) United States Patent
Gayral Chirac et al.

(10) Patent No.: US 9,080,132 B2
(45) **Date of Patent: *Jul. 14, 2015**

(54) USE OF HEPTYLPOLYGLYCOSIDES FOR SOLUBILISING NON-IONIC SURFACTANTS IN AQUEOUS ACIDIC CLEANING COMPOSITIONS, AND AQUEOUS ACIDIC CLEANING COMPOSITIONS COMPRISING SAME

(75) Inventors: Marie-Francoise Gayral Chirac, Viviers-les-Montagnes (FR); Sebastien Kerverdo, Vincennes (FR); Jerome Guilbot, Castres (FR); Herve Rolland, Castres (FR)

(73) Assignee: SOCIETE D'EXPLOITATION DE PRODUITS POUR LES INDUSTRIES CHIMIQUES SEPPIC, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 14/122,684

(22) PCT Filed: May 14, 2012

(86) PCT No.: PCT/FR2012/051070

§ 371 (c)(1),
(2), (4) Date: Nov. 27, 2013

(87) PCT Pub. No.: WO2012/164190

PCT Pub. Date: Dec. 6, 2012

(65) Prior Publication Data

US 2014/0113850 A1 Apr. 24, 2014

(30) Foreign Application Priority Data

May 27, 2011 (FR) ..... 11 54653

(51) Int. Cl.

| | |
|---|---|
| ***C11D 1/722*** | (2006.01) |
| ***C11D 1/825*** | (2006.01) |
| ***C11D 3/22*** | (2006.01) |
| ***B08B 3/04*** | (2006.01) |
| ***C11D 3/00*** | (2006.01) |
| ***C11D 3/04*** | (2006.01) |
| ***C11D 3/20*** | (2006.01) |
| *C11D 1/66* | (2006.01) |
| *C11D 1/72* | (2006.01) |

(52) U.S. Cl.

CPC ..... *C11D 3/221* (2013.01); *C11D 1/825* (2013.01); *C11D 1/8255* (2013.01); *C11D 3/0026* (2013.01); *C11D 3/042* (2013.01); *C11D 3/2075* (2013.01); *C11D 1/662* (2013.01); *C11D 1/72* (2013.01); *C11D 1/722* (2013.01)

(58) Field of Classification Search

CPC ..... C11D 1/722; C11D 1/825; C11D 3/22; B08B 3/04

USPC ..... 510/421, 470, 474, 475; 134/25.2, 25.3, 134/39, 42

See application file for complete search history.

(56) References Cited

U.S. PATENT DOCUMENTS

| | | | | |
|---|---|---|---|---|
| 5,205,959 | A * | 4/1993 | Schmid et al. | 510/422 |
| 6,015,839 | A | 1/2000 | Milius | |

FOREIGN PATENT DOCUMENTS

| | | | |
|---|---|---|---|
| EP | 0 524 075 | A1 | 1/1993 |
| FR | 2 733 246 | A1 | 10/1996 |
| WO | 9633255 | A1 | 10/1996 |
| WO | 99/21948 | A1 | 5/1999 |

OTHER PUBLICATIONS

French Search Report, dated Jan. 11, 2012, from corresponding French application.

International Search Report, dated Oct. 5, 2012, from corresponding PCT application.

* cited by examiner

*Primary Examiner* — Brian P Mruk

(74) *Attorney, Agent, or Firm* — Young & Thompson

(57) ABSTRACT

A composition (C) of formula (I): $R_1$—O-$(G)_p$-H (I). G is a reducing sugar, $R_1$ is a heptyl radical, p is a decimal number, and $1<p\leq5$. Composition (C) is a mixture of compounds of five formulae: $R_1$—O-$(G)_1$-H ($I_1$), $R_1$—O-$(G)_2$-H ($I_2$), $R_1$—O-$(G)_3$-H ($I_3$), $R_1$—O-$(G)_4$-H ($I_4$), and $R_1$—O-$(G)_5$-H ($I_5$). The sum of their molar proportions $a_1$, $a_2$, $a_3$, $a_4$ and $a_5$ equals 1, and $p=a_1+2a_2+3a_3+4a_4+5a_5$. Composition (C) is a solubilising agent in an acidic aqueous composition for non-ionic surfactant(s) according to: R—(O—CH(R')—$CH_2)_n$—(O—$CH_2$—$CH_2)_m$—O—H (II). R is a C8-C14 aliphatic radical, R' is $CH_3$ or $CH_2CH_3$, $0\leq n\leq15$, $0\leq m\leq15$, and $(n+m)>0$. Also, compositions ($C_1$) having 0.2-40% mass of composition(s) (C) and 0.2-80% mass non-ionic surfactant(s) of formula (II), which may be used to clean hard surfaces.

18 Claims, No Drawings

USE OF HEPTYLPOLYGLYCOSIDES FOR SOLUBILISING NON-IONIC SURFACTANTS IN AQUEOUS ACIDIC CLEANING COMPOSITIONS, AND AQUEOUS ACIDIC CLEANING COMPOSITIONS COMPRISING SAME

The present invention relates to the use of an n-heptyl polyglycoside or a mixture of n-heptyl polyglycosides for solubilising low-foam non-ionic surfactants in stable compositions in acidic media, particularly used for cleaning and descaling hard surfaces.

The term solubilising agent denotes any substance or chemical composition suitable for solubilising, in water or in aqueous phases, chemical compounds which are poorly soluble or insoluble in water or in such aqueous phases. The expression "chemical compounds which are poorly soluble in water or in aqueous phases" denotes compounds which, when added to a phase mainly or completely consisting of water, are not suitable for obtaining a completely clear, transparent, isotropic and homogeneous solution or composition, stable at a required temperature for a required time. This lack of solubility is particularly due to the chemical structure of the compound in question and/or the presence of acidic agents in the aqueous phase wherein said compound is to be solubilised.

Among the compounds which are poorly soluble or insoluble in water, mention may be made of hydrophobic compounds such as, for example, oils, essential oils, fragrances, dyes, anionic surfactants, cationic surfactants, non-ionic surfactants and amphoteric surfactants.

The solubilising agents are particularly used for preparing cleaning compositions for cleaning hard surfaces for household or industrial applications.

Among the cleaning compositions for cleaning hard surfaces for household or industrial applications, a distinction may be made between alkaline aqueous cleaning compositions, characterised by a pH greater than 7.0, and acidic aqueous cleaning compositions characterised by a pH less than or equal to 7.0.

Acidic aqueous cleaning compositions are used for cleaning hard surfaces, i.e. not merely for removing dirt from said hard surfaces, but also for descaling said surface. Such compositions are particularly suitable for cleaning and descaling facilities in the food processing industry, such as the dairy, brewing and wine industries. They are also suitable for cleaning and descaling electrical appliances, such as dishwashers and coffee machines. These industrial facilities and these electrical appliances comprise circuits and vessels, which after a certain operating time, are soiled with organic matter, such as for example fats, and more particularly phospholipids, proteins, tannins, and with mineral deposits of calcium salts, more particularly calcium carbonates, phosphates and oxalates.

These acidic aqueous cleaning compositions are also particularly suitable for cleaning and descaling enamel in bathroom fittings, wash basins, baths and showers.

These acidic aqueous cleaning compositions are also used for treating metal surfaces or cast or forged metal parts, for removing deposits formed by metal corrosion or oxidation, such as rust, oxide layers, verdigris, or deposits of soot, limescale, etc.

These acidic aqueous cleaning compositions are also used in cleaning operations for removing concrete or cement residue, and for operations for cleaning ground-in grease on concrete surfaces prior to any operation for painting said concrete surfaces.

These acidic aqueous cleaning compositions should not generate significant foam formation during the cleaning operation in the presence of the dirt to be treated, exhibit satisfactory wetting properties and also satisfactory cleaning power in acidic media.

Due to the amphiphilic structure thereof, the detergent surfactants used in the acidic aqueous cleaning compositions for cleaning hard surfaces give same the ability to remove the dirt present on the hard surfaces and keep said dirt suspended, for subsequent removal during the rinsing step. These detergent surfactants may be anionic, cationic, amphoteric or non-ionic in nature. Non-ionic surfactants are particularly used for preparing compositions for cleaning hard surfaces in view of the generally lower foaming power thereof in relation to other ionic surfactants and also the enhanced environmental features thereof.

As these cleaning compositions comprise large quantities of acidic agents, it is difficult to dissolve large quantities of detergent surfactants to obtain a stable composition, exhibiting no phase shift during storage.

To enhance the solubility of chemical compounds which are poorly soluble or insoluble in water or in aqueous phases, those skilled in the art use solubilising agents such as ethanol, xylene sulphonates and cumene sulphonates. Ethanol is an effective solubilising agent but exhibits a degree of explosiveness in acidic media. The European patent application published under the number EP 0 524 075 A1 describes the efficacy of acidic aqueous cleaning compositions comprising an anionic solubilising or hydrotropic agent and non-ionic surfactants. However, anionic solubilising agents, such as xylene sulphonates and cumene sulphonates, are relatively ineffective for large quantities of surfactants and also do not exhibit the required biodegradability properties to comply with new environmental regulations.

Alkylpolyglycosides are also described as agents for solubilising anti-foaming non-ionic surfactants.

The international publication WO 96/33255 A1 describes anti-foaming compositions comprising a particular alkylpolyglucoside, wherein the alkyl chain consists of the 2-ethyl hexyl radical and anti-foaming non-ionic surfactant agents chosen from those comprising one or a plurality of groups chosen from the mono-ethoxylated or polyethoxylated groups, mono-propoxylated or poly-propoxylated groups. It is taught therein that 2-ethyl hexyl chain alkylpolyglucosides are more effective than hexyl chain alkyl polyglycosides for solubilising anti-foaming non-ionic surfactants.

The international publication WO 99/21948 A1 discloses compositions which are clear and stable at high alkaline concentrations, wherein the foaming properties are controlled, containing a large quantity of non-ionic surfactants based on alkylene oxide and a hexyl glycoside as a hydrotropic or solubilising agent. These compositions are characterised by a satisfactory wetting power and satisfactory cleaning properties on hard surfaces. It is taught therein that hexyl glycosides, and more particularly n-hexyl polyglucoside, are agents for solubilising non-ionic surfactants in strongly alkaline media and that n-hexyl glucoside is characterised by a superior solubilising power for a non-ionic surfactant wherein the structure is the result of the ethoxylation with 4 moles of ethylene oxide of a mixture of linear and branched alcohols, with a linear alcohol content of approximately 80%, comprising from 9 to 11 carbon atoms, in relation to 2-ethyl hexyl glucoside and Exxal 7 glucoside in the presence of quantities of sodium hydroxide between 10% and 40%.

The U.S. patent published under the number U.S. Pat. No. 5,205,959 describes a mixture comprising, per 100% by mass:

(i) 1.5% to 30% by mass alkylpolyglycosides wherein the alkyl chain comprises 6 to 12 carbon atoms and wherein the degree of polymerisation is between 1 and 2, (ii) 5% to 70% by mass alcohols comprising from 16 to 20 carbon atoms, branched in position 2, polyethoxylated, with a number of ethylene oxide structural units between 5 and 9, wherein the terminal hydroxy function is bound by an ether function with an alkyl chain comprising from 4 to 8 carbon atoms, (iii) 5% to 70% by mass alcohols, comprising an even number of carbon atoms between 12 and 20, polyethoxylated with a number of ethylene oxide structural units between 2 and 5.

The applicant has thus undertaken to develop a novel technical solution, consisting of the use of an n-heptyl polyglycoside or a mixture of n-heptyl polyglycosides, exhibiting a non-flammable nature and non-ecotoxic and biodegradable properties, for solubilising non-ionic surfactants in aqueous compositions stable in acidic media, particularly used for cleaning and descaling hard surfaces.

For this reason, according to a first aspect, the invention relates to the use of a composition (C) represented by formula (I):

$$\underline{R_1}\text{—O-(G)}_p\text{-H} \quad (I)$$

wherein G is a reducing sugar residue, $R_1$ is a heptyl radical and p is a decimal number greater than 1, and less than or equal to 5, said composition (C) consisting of a mixture of compounds represented by the formulae ($I_1$), ($I_2$), ($I_3$), ($I_4$) and ($I_5$):

$$R_1\text{—O-(G)}_1\text{-H} \quad (I_1)$$

$$R_1\text{—O-(G)}_2\text{-H} \quad (I_2)$$

$$R_1\text{—O-(G)}_3\text{-H} \quad (I_3)$$

$$R_1\text{—O-(G)}_4\text{-H} \quad (I_4)$$

$$R_1\text{—O-(G)}_5\text{-H} \quad (I_5),$$

in the following respective molar proportions:

$a_1$ for the compound according to formula ($I_1$), $a_2$ for the compound according to formula ($I_2$), $a_3$ for the compound according to formula ($I_3$), $a_4$ for the compound according to formula ($I_4$) and $a_5$ for the compound according to formula ($I_5$) such that:

the sum $a_1+a_2+a_3+a_4+a_5$ is equal to 1 and that the sum $a_1+2a_2+3a_3+4a_4+5a_5$ is equal to p, as an agent for solubilising at least one non-ionic surfactant according to formula (II):

$$R\text{—(O—CH(R')—CH}_2)_n\text{—(O—CH}_2\text{—CH}_2)_m\text{—O—H} \quad (II)$$

wherein R is a saturated or unsaturated, linear or branched, hydrocarbon aliphatic radical, comprising from 8 to 14 carbon atoms, R' is a methyl or ethyl radical, and preferably the n-heptyl radical n is an integer greater than or equal to 0 and less than or equal to 15, m is an integer greater than or equal to 0 and less than or equal to 15, it being understood that the sum n+m is greater than zero, in an aqueous acidic composition.

In the definition of the use according to the present invention, the expression "aqueous acidic composition" denotes any aqueous composition having a pH less than or equal to 7.

The term reducing sugar denotes, in the composition represented by formula (I), saccharide derivatives not having in the structures thereof any glycoside bonds formed between an anomeric carbon and the oxygen of an acetal group as defined in the reference publication: "Biochemistry", Daniel Voet/Judith G. Voet, p. 250, John Wyley & Sons, 1990. The oligomeric structure $(G)_p$, may be in any form of isomerism, either optical isomerism, geometric isomerism or position isomerism; it may also be a mixture of isomers.

The term solubilising agent denotes any substance or chemical composition suitable for solubilising, in water or in aqueous phases, chemical compounds which are poorly soluble or insoluble in water or in such aqueous phases. The expression "chemical compounds which are poorly soluble in water or in aqueous phases" denotes compounds which, when added to a phase mainly or completely consisting of water, are not suitable for obtaining a completely clear, transparent, isotropic and homogeneous solution or composition, stable at a required temperature for a required time.

In formula (I) as defined above, the group $R_1$—O is bound with G by the anomeric carbon of the saccharide residue, so as to form an acetal function. G is the residue of a reducing sugar chosen essentially from glucose, dextrose, sucrose, fructose, idose, gulose, galactose, maltose, isomaltose, maltotriose, lactose, cellobiose, mannose, ribose, xylose, arabinose, lyxose, allose, altrose, dextran or tallose.

According to one particular aspect of the present invention, the invention relates to the use as defined above for which, in formula (I), p is a decimal number greater than or equal to 1.05 and less than or equal to 2.5.

According to a further aspect of the present invention, the invention relates to the use as defined above for which, in formula (I), G is a reducing sugar residue chosen from glucose, xylose and arabinose residues, and more particularly chosen from glucose or xylose residues.

The composition represented by formula (I) is particularly prepared according to a method comprising the following successive steps:

a step A) for reacting a reducing sugar according to formula (III):

$$\text{HO-(G)-H} \quad (III)$$

wherein G is a reducing sugar residue, with a molar excess of n-heptanol according to formula R1-OH, to form a mixture of compounds according to formula (I) as defined above and n-heptanol;

a step B) for removing n-heptanol from said mixture obtained in step A).

Step A) is generally carried out in a reactor in the presence of an acidic catalytic system, controlling the stoichiometric ratio between the two reactants, and more particularly by introducing a molar excess of n-heptanol, and with mechanical stirring under predefined temperature and partial vacuum conditions, for example at a temperature between 70° C. and 130° C. and in a partial vacuum between 300 mbar ($3\cdot10^4$ Pa) and 20 mbar ($2\cdot10^3$ Pa). The term acidic catalytic system denotes strong acids such as sulphuric acid, hydrochloric acid, phosphoric acid, nitric acid, hypophosphorous acid, methanesulphonic acid, (para-toluene) sulphonic acid, (trifluoromethane) sulphonic acid, or ion exchange resins.

Step B) for removing n-heptanol from said mixture obtained following step A) is generally carried out according to methods known to those skilled in the art such as, for example, distillation, thin film distillation, molecular distillation or solvent extraction.

Such a preparation method may be completed, if necessary or if desired, by neutralisation, filtration and discolouration operations.

In the use as defined above, the term saturated or unsaturated, linear or branched hydrocarbon aliphatic radical, comprising from 8 to 14 carbon atoms, optionally substituted with one or a plurality of hydroxyl groups, denotes for the radical R in formula (II):

Linear alkyl radicals, for example n-octyl, n-decyl, n-dodecyl or n-tetradecyl radicals;

Radicals based on isoalkanols according to formula (I):

$$(CH_3)(CH_3)CH—(CH_2)_r—CH_2—OH \quad (1)$$

wherein r is an integer between 4 and 10, for example the isooctyl, isononyl, isodecyl, isoundecyl, isododecyl, isotridecyl or isotetradecyl radicals;

The 2-ethyl hexyl radical or branched alkyl radicals based on Guerbet alcohols according to formula (2):

$$CH(C_sH_{2s+1})(C_tH_{2t+1})—CH_2—OH \quad (2)$$

wherein t is an integer between 4 and 10, s is an integer between 2 and 10 and the sum s+t is greater than or equal to 6, and less than or equal to 12, for example the 2-ethyl decyl, 2-butyl octyl, 2-ethyl dodecyl, 2-butyl decyl, 2-hexyl octyl, 2-butyl decyl, 2-hexyl octyl radicals; or radicals based on Guerbet alcohol homologues, for example the 2-propyl heptyl radical.

Radicals based on branched alcohols according to formula (3):

$$CH_3—[CH(R'')]_z—CH_2—OH \quad (3)$$

wherein R" is a hydrogen atom or a methyl radical, and z is an integer greater than or equal to 3 and less than or equal to 15.

Unsaturated linear radicals such as undecenyl, dodecenyl or tetradecenyl radicals, such as for example unsaturated 10-undecenyl, 4-dodecenyl, or 5-dodecenyl radicals;

Saturated or unsaturated, linear or branched aliphatic radicals, comprising from 8 to 14 carbon atoms substituted with one or two hydroxy groups, such as hydroxy octyl, hydroxydecyl, hydroxydodecyl groups, for example 8-hydroxy octyl, 10-hydroxy decyl or 12-hydroxy dodecyl radicals.

According to a further particular aspect of the present invention, the invention relates to the use as defined above for which, in formula (II), the radical R is a radical chosen from the octyl, decyl, dodecyl, tetradecyl, 2-ethyl hexyl, 2-butyl octyl, 2-butyl decyl, 2-hexyl octyl, isooctyl, isononyl, isodecyl, isoundecyl, isododecyl, isotridecyl, isotetradecyl or 2-propyl heptyl radicals.

According to a further particular aspect of the present invention, the invention relates to the use as defined above for which, in formula (II), n is an integer greater than or equal to 0 and less than or equal to 6, more particularly greater than or equal to 0 and less than or equal to 3, and even more particularly greater than or equal to 0 and less than or equal to 2.

According to a further particular aspect of the present invention, the invention relates to the use as defined above for which, in formula (II), n is an integer greater than or equal to 1 and less than or equal to 9, more particularly greater than or equal to 2 and less than or equal to 6, and even more particularly greater than or equal to 2 and less than or equal to 4.

The compounds according to formula (II) for which R' is a methyl or ethyl radical and n is an integer greater than or equal to 1 are prepared according to a method comprising if necessary an alkoxylation step a) by reacting n molar equivalents of an alkylene oxide or an alkylene carbonate with one molar equivalent of alcohol according to formula (IV):

$$R—OH \quad (IV)$$

wherein the radical R is a saturated or unsaturated, linear or branched, hydrocarbon aliphatic radical, comprising from 8 to 14 carbon atoms, optionally substituted with one or a plurality of hydroxyl groups, as defined above, to obtain the alkoxylated alcohol according to formula (V):

$$R—(O—CH(R')—CH_2)_n—O—H \quad (V)$$

wherein R' is a methyl or ethyl radical; and/or if required an ethoxylation step b) by reacting one molar equivalent of the alkoxylated alcohol according to formula (V) obtained following step a) with m molar equivalents of ethylene oxide or ethylene carbonate.

In step a) of the method for preparing compounds according to formula (II) as described above, the alkylene oxide is chosen from the elements of the group consisting of propylene oxide and butylene oxide, and the alkylene carbonate is chosen from the elements of the group consisting of propylene carbonate and butylene carbonate.

The compounds according to formula (II) for which n is equal to 0 are prepared according to a method involving an ethoxylation step a') by reacting m molar equivalents of ethylene oxide or ethylene carbonate with the alcohol according to formula (IV) as defined above.

In the methods described above, n and m are the integers described above in the definition of the compounds according to formula (II).

The reactions in respect of alkoxylation in step a) and ethoxylation in steps a') and b), as defined above, are generally carried out in a reactor in the presence of a basic catalyst such as alkaline metal hydroxides, such as for example sodium hydroxide, potash, alkaline alcoholates, such as for example sodium or potassium methylate, sodium or potassium tertiobutylate, Lewis bases such as for example triphenylphosphine, coordination catalysts such as for example cobalt and/or zinc-based organometallic compounds, or in the presence of an acidic catalyst such as a Lewis acid such as for example boron trifluoride, aluminium trichloride or tin tetrachloride.

Such methods for preparing compounds according to formula (II) may be completed, if necessary or if desired, by neutralisation, filtration and discolouration operations.

According to a further particular aspect of the present invention, the invention relates to the use as defined above, wherein the mass ratio between said non-ionic surfactant according to formula (II) and said composition (C) is less than or equal to 15:1 and greater than or equal to 1:1.

According to a further aspect, the invention relates to a composition ($C_1$) comprising per 100% by mass:

a) 0.2% to 40% by mass, more particularly 0.2% to 20% by mass, and even more particularly 0.2% to 15% by mass of a composition ($C_1$) comprising per 100% by mass:

a) 0.2% to 40% by mass of said composition (C) represented by formula (I):

$$R_1—O-(G)_p-H \quad (I)$$

wherein G is a reducing sugar residue, $R_1$ is a heptyl radical and p is a decimal number greater than 1, and less than or equal to 5, said composition (C) consisting of a mixture of compounds represented by the formulae ($I_1$), ($I_2$), ($I_3$), ($I_4$) and ($I_5$):

$$R_1—O-(G)_1-H \quad (I_1)$$

$$R_1—O-(G)_2-H(I_2)$$

$$R_1—O-(G)_3-H_(I_3)$$

$$R_1—O-(G)_4-H \quad (I_4)$$

$$R_1—O-(G)_5-H \quad (I_5),$$

in the following respective molar proportions:

$a_1$ for the compound according to formula ($I_1$), $a_2$ for the compound according to formula ($I_2$), $a_3$ for the compound according to formula ($I_3$), $a_4$ for the compound according to formula ($I_4$) and $a_5$ for the compound according to formula ($I_5$) such that:

the sum $a_1+a_2+a_3+a_4+a_5$ is equal to 1 and that the sum $a_1+2a_2+3a_3+4a_4+5a_5$ is equal to p, b) 0.2% to 80% by mass, more particularly 0.2% to 40% by mass, and even more particularly 0.2% to 20% by mass of at least one non-ionic surfactant according to formula (II):

$$R—(O—CH(R')—CH_2)_n—(O—CH_2—CH_2)_mO—H \quad (II)$$

wherein R is a saturated or unsaturated, linear or branched hydrocarbon aliphatic radical, comprising from 8 to 14 carbon atoms, R' is a methyl or propyl radical, n is an integer greater than or equal to 0 and less than or equal to 15, m is an integer greater than or equal to 0 and less than or equal to 15, it being understood that the sum n+m is greater than zero;

c) 1% to 50% by mass, more particularly 1% to 40% by mass and even more particularly 1% to 35% by mass of at least one acidic agent chosen from the elements of the group consisting of mineral acids and organic acids; and d) 1% to 98.6% by mass, more particularly 20% to 98.6% by mass, and even more particularly 40% to 98.6% by mass of water.

Among the mineral acids particularly chosen as acidic agents in the composition ($C_1$) according to the invention, mention may be made of hydrochloric acid, nitric acid, phosphoric acid, sulphuric acid, hypophosphorous acid, phosphorous acid, hypochlorous acid, perchloric acid, carbonic acid, boric acid, manganic acid, permanganic acid, chromic acid, periodic acid, iodic acid, hypoiodous acid, hydrobormic acid, hydriodic acid, hydrofluoric acid.

Among the organic acids particularly chosen as acidic agents in the composition ($C_1$) according to the present invention, mention may be made of formic acid, acetic acid, propionic acid, benzoic acid, salicylic acid, oxalic acid, malonic acid, succinic acid, glutaric acid, adipic acid, glycolic acid, lactic acid, malic acid, maleic acid, tartaric acid, citric acid, sorbic acid, sulphamic acid, dihydroacetic acid, dimethylsulphamic acid, fumaric acid, glutamic acid, isopropyl sulphamic acid, valeric acid, benzene sulphonic acid, xylene sulphonic acid, 2-ethyl-hexanoic acid, capric acid, caproic acid, cresylic acid, dodecylbenzene sulphonic acid, peracetic acid, monochloroacetic acid, gluconic acid.

According to one more particular aspect, in the composition ($C_1$) according to the present invention, the acidic agent is chosen from hydrochloric acid, nitric acid, phosphoric acid, sulphuric acid, hydrofluoric acid, hypochlorous acid, formic acid, acetic acid, salicylic acid, oxalic acid, citric acid, tartaric acid, gluconic acid, peracetic acid, glycolic acid, lactic acid.

According to one particular aspect, in the composition ($C_1$) according to the present invention, the mass ratio between the compound according to formula (II) and said composition (C) is less than or equal to 15:1 and greater than or equal to 1:1.

According to a further aspect, the invention relates to the use of a composition ($C_1$) as defined above, for cleaning hard surfaces.

The expression "for cleaning hard surfaces" denotes any action intended to remove dirt found on surfaces consisting of various materials. The term hard surfaces denotes for example floors, vertical surfaces, tiles, electrical appliances such as for example dishwashers and coffee machines, valves and fittings, sinks, wash basins, baths, showers, toilets, urinals, food or agricultural product storage tanks, vehicles (cars, motorbikes, trucks, etc.), industrial facilities such as for example heat exchangers, sea water evaporators, pipework, heating circuits, cooling circuits, construction equipment soiled with cement or concrete such as for example concrete mixers, cement and concrete truck mixers, metal surfaces and cast or forged metal parts.

The constituent materials of these hard surfaces are for example glass (soda-lime, fluorine-lime, borosilicate, crystal), enamel, porcelain, earthenware, ceramics, polycarbonate plastics, polypropylenes, stainless steel, silver, copper, aluminium and more particularly highly oxidised aluminium, brasses and copper alloys, precious metals such as for example gold, silver, platinum, wood, synthetic resins, vitroceramic, linoleum, and may be coated with paints or varnishes.

As examples of dirt found on these hard surfaces to be removed by cleaning, mention may be made for example of food residue such as for example deposits caused by dairy products and food residue containing sugar, fats such as phospholipids, proteins, tannins, algae, heavy and light hydrocarbons, burnt residue, soap residue, germs, carbon-based marks such as for example soot, mineral deposits of calcium salts such as for example calcium carbonate, calcium phosphate or calcium oxalate, incrustation, limescale, metal oxide deposits such as for example rust, verdigris, glue residue, mortar residue, cement residue, lime residue.

The composition ($C_1$) according to the present invention is particularly in the form of an aqueous solution, an emulsion or a microemulsion with a continuous aqueous phase, an emulsion or microemulsion with a continuous oily phase, an aqueous gel, a foam, or in the form of an aerosol.

The composition ($C_1$) according to the present invention may be applied directly by soaking, spraying or atomising onto the surface to be cleaned or by means of any type of substrate intended to be placed in contact with the hard surface to be cleaned (paper, wipe, cloth) comprising said composition ($C_1$).

The composition ($C_1$) according to the present invention, used for cleaning hard surfaces, generally has a pH less than or equal to 7, more particularly less than or equal to 6, more particularly less than or equal to 4 and even more particularly less than or equal to 2.

As a general rule, the composition ($C_1$) according to the present invention, also comprises ingredients routinely used in the field of cleaning hard surfaces, such as non-ionic surfactants, cationic surfactants, amphoteric surfactants, cationic polymers, non-ionic polymers, thickening agents, enzymes, bleaching agents, anti-corrosion agents, solvents, preservatives, fragrances, dyes, repellent agents, oxidising agents.

As examples of non-ionic surfactants contained in the composition ($C_1$) according to the present invention, mention may be made of:

Ethylene oxide and propylene oxide block copolymers, and more particularly ethylene oxide and propylene oxide block copolymers marketed under the brand name PLURONIC™ by BASF, such as for example PLURONIC™ PE 6100 and PLURONIC™ PE 6200, Anti-foaming non-ionic surfactants according to formula ($A_1$):

$$R_1—X—[(CH_2—CH(CH_3)—O)_u—(CH_2—CH_2—O)_v—Y]w \quad (A_1)$$

wherein:

$R_1$ is a saturated or unsaturated, linear or branched hydrocarbon aliphatic radical, comprising from 6 to 18 carbon atoms, X is a nitrogen atom or an oxygen atom, v is an integer between 1 and 50, u is an integer between 1 and 50, w is an integer equal to 1 if X is an oxygen atom, and w is an integer equal to 1 or 2 if X is a nitrogen atom.

Y is a blocking functional group chosen from the elements of the group consisting of linear alkyl radicals comprising from 4 to 8 carbon atoms, such as for example the butyl radical, the benzyl radical, a butylene oxide group.

Among the anti-foaming non-ionic surfactants according to formula ($A_1$), mention may be made of the products marketed under the brand name TERGITOL™ by DOW CHEMICAL such as for example TERGITOL™ L61E and TERGITOL™ L64E Low-foam non-ionic surfactants according to formula ($A_2$):

$$R_2—O—(S)_q—H \qquad (A_2)$$

wherein:

S is the residue of a reducing sugar chosen from the elements of the group consisting of glucose, xylose and arabinose, $R_2$ is a linear or branched saturated hydrocarbon radical, comprising from 6 to 10 carbon atoms q is a decimal number greater than or equal to 1.05 and less than or equal to 5.

As examples of low-foam non-ionic surfactants according to formula ($A_2$) contained in the composition ($C_1$) according to the present invention, mention may be made of hexylpolyglucosides and 2-ethylpolyglucosides.

As examples of amphoteric surfactants contained in the composition ($C_1$) according to the present invention, mention may be made of sodium N-(2-carboxyethyl)-N-(2-ethylhexyl) β alaninate, marketed under the brand name TOMAMINE® AMPHOTERIC 400 SURFACTANT.

As examples of thickening agents contained in the composition ($C_1$) according to the present invention, mention may be made of polymeric hydrocolloids of plant or biosynthetic origin, such as xanthan gum, scleroglucan, tragacanth, agar-agar, carraghenates, alginic acid, alginates and galactomannans; cellulose and derivatives thereof such as for example hydroxypropylmethyl cellulose; dextrin; casein; pectins; gelatin; chitosan; polyethylene glycols having a molecular weight between 4,000 and 35,000 grams per mole; ethoxylated ethylene glycol derivatives having a molecular weight between 300,000 and 7,000,000 grams per mole.

As examples of thickening agents contained in the composition ($C_1$) according to the present invention, mention may be made of polymeric thickening agents such as acrylamide homopolymers, or acrylamide copolymers and the sodium salt of 2-acrylamido-2-methylpropanesulphonate, such as for example the thickening agents marketed by SEPPIC under the brand name SOLAGUM™

As examples of thickening agents contained in the composition ($C_1$) according to the present invention, mention may be made of inorganic thickening agents such as for example clays, hectorite, saponite, sauconite, vermiculite or colloidal silica.

The thickening agents contained in the composition ($C_1$) according to the present invention are used in quantities between 0.1% and 10% by mass.

As examples of abrasive agents contained in the composition ($C_1$) according to the present invention, mention may be made of materials of natural origin such as for example wood or kernal chippings, inorganic abrasive materials such as oxides, quartzes, diatomaceous earths, colloidal silica dioxides, organic abrasive materials such as polyolefins like polyethylenes and polypropylenes, polystyrenes, acetonitrile-butadiene-styrene resins, melamines, phenolic resins, epoxy resins, polyurethane resins.

The abrasive agents contained in the composition ($C_1$) according to the present invention are used in quantities between 5.0% and 30% by mass.

As examples of solvents contained in the composition ($C_1$) according to the present invention, mention may be made of isopropyl alcohol, benzyl alcohol, 1,3 propane diol, chlorinated solvents, acetone, methyl ethyl ether, methyl isobutyl ether, butyl acetate, ethyl acetate, isopropyl acetate, isobutyl acetate, aromatic solvents, isoparaffins, isododecane, ethyl lactate, butyl lactate, terpene-based solvents, rape methyl esters, sunflower methyl esters, propylene glycol n-methyl ether, dipropylene glycol n-methyl ether, tripropylene glycol n-methyl ether, propylene glycol n-butyl ether, dipropylene glycol n-butyl ether, tripropylene glycol n-butyl ether, propylene glycol n-propyl ether, dipropylene glycol n-propyl ether, propylene glycol mono methyl ether acetate, propylene glycol di acetate, propylene glycol phenyl ether, ethylene glycol phenyl ether, dipropylene glycol dimethyl ether.

As examples of solvents contained in the composition ($C_1$) according to the present invention, more particular mention may be made of the elements of the group consisting of propylene glycol n-methyl ether, dipropylene glycol n-methyl ether, tripropylene glycol n-methyl ether, propylene glycol n-butyl ether, dipropylene glycol n-butyl ether, tripropylene glycol n-butyl ether, propylene glycol n-propyl ether, dipropylene glycol n-propyl ether, propylene glycol phenyl ether, ethylene glycol phenyl ether, dipropylene glycol dimethyl ether, rape methyl esters, sunflower methyl esters.

According to a further aspect, the invention relates to a method for cleaning a hard surface characterised in that it comprises:

at least one step $a_1$) for applying the composition ($C_1$) as defined above onto said hard surface, followed by at least one step $b_1$) for rinsing said hard surface.

In step $a_1$) of the cleaning method according to the invention, the composition ($C_1$) is applied onto the surface comprising the dirt to be cleaned using any means such as for example by dipping, soaking, spraying, applying by means of a substrate consisting of woven or non-woven synthetic or natural textile fibres, or paper, previously impregnated with said composition ($C_1$).

In step $b_1$) of the cleaning method according to the invention, the hard surface whereon the composition ($C_1$) was applied during step $a_1$) is rinsed by dipping in or spraying with water.

Step $b_1$) of the cleaning method according to the invention may be carried out at ambient temperature or at a temperature between 15° C. and 80° C., more particularly at a temperature between 15° C. and 65° C.

The following examples illustrate the invention, but without having a limiting effect.

1) Preparation of Compositions Represented by Formula (I) and Evaluation of the Surfactant Properties Thereof 1.1) Preparation of n-Heptylpolyglucosides 2.7 molar equivalents of n-heptanol are introduced into a double-jacketed glass reactor, wherein a heat transfer fluid circulates, and equipped with effective stirring, at a temperature of 40° C. One molar equivalent of anhydrous glucose is then added gradually to the reaction medium to enable the homogeneous dispersion thereof, followed by 0.15% by mass of 98% sulphuric acid and 0.15% by mass of 50% hypophosphorous acid per 100% of the mass consisting of the sum of the mass of glucose and masse and n-heptanol are introduced into the previously prepared homogeneous dispersion. The reaction medium is placed in a partial vacuum of approximately $18\times10^3$ Pa (180 mbar), and maintained at a temperature of 100° C.-105° C. for a period of 4 hours with discharging of the water formed by means of a distillation apparatus. The reaction medium is then cooled to 85° C.-90° C. and neutralised by adding 40% sodium hydroxide, to adjust the pH of a 5% solution of this mixture to a value of approximately 7.0. The reaction medium obtained is then drained at a temperature of 70° C. and filtered to remove the unreacted grains of glucose. The filtrate is then introduced into a double jacketed glass reactor, wherein a heat transfer fluid circulates, equipped with effective stirring and a distillation device. The excess heptanol is then removed by distillation at a temperature of 120° C. in a partial vacuum between approximately $10^4$ Pa (100 mbar) and $5\times10^3$ Pa (50 mbar). The reaction medium distilled in this way is diluted immediately by adding a quantity of water so as to attain a reaction medium concentration of approximately 60%. After homogenising for 30 minutes at a temperature of 50° C., the composition ($X_0$) obtained is drained.

The analytical characteristics of the composition ($X_0$) obtained comprising n-heptylpolyglucosides are compiled in table 1 below.

TABLE 1

| | Composition ($X_0$) |
|---|---|
| Appearance at 20° C. (Visual determination) | Liquid |
| Acid value (NFT 60204 standard) | 1.7 |
| Hydroxyl value on dry extract (USP XXI NF XVI Jan. 1, 1995 standard) | 813.9 |
| Water (% by mass) (NFT 73201 standard) | 58.8% |
| Residual n-heptanol content (gas chromatography) as a % by mass | 0.22% |

1.2) Evaluation of Foaming Properties of n-Heptylpolyglucosides

The foaming properties of the n-heptylpolyglucoside composition ($X_0$), obtained according to the method described above, as well as the compositions ($X_1$), ($X_2$), ($X_3$), and ($X_4$) according to the prior art, were evaluated according to a static nitrogen bubbling method.

- Composition ($X_1$): N-hexylpolyglucoside composition marketed under the brand name AG 6206™ by AKZO NOBEL;
- Composition ($X_2$): 2-ethylhexylpolyglucoside composition marketed under the brand name AG 6202™ by NOBEL AKZO;
- Composition ($X_3$): N-octylpolyglucoside/n-decylpolyglucoside composition marketed under the brand name SIMULSOL™ SL8 (composition $X_3$) by SEPPIC;
- Composition ($X_4$): Sodium xylene sulphonate (composition $X_4$) marketed under the brand name STEPANATE SXS-E™ by STEPAN.

1.2.1) Principle of Static Nitrogen Bubbling Method for Evaluating Foaming Power Foam is formed by introducing a defined volume of nitrogen into a fixed-concentration surfactant solution and in the presence of a fixed quantity of sodium hydroxide, at a specific temperature. The volume of foam generated by introducing the nitrogen volume is measured at the end of the introduction of said nitrogen volume, and subsequently at a time of 30 seconds, and 120 seconds after the end of the introduction of the nitrogen volume.

1.2.2) Experimental Protocol

50 $cm^3$ of 5 $mg/cm^3$ dry extract solution of the compositions under test is introduced into a 250 $cm^3$ thermostatically controlled graduated test tube along with a quantity of 12.5 g of sodium hydroxide. The measurements were made at 20° C. and 60° C. A gas dispensing pin of porosity 3 (ref Corning Pyrex 853-1) is positioned such that the end of the sintered tip is situated one centimeter from the bottom of the test tube. The nitrogen flow rate is then specifically set to 50 litres per hour and bubbling is performed for 15 seconds. After this time, the nitrogen supply is shut off and the investigator records the initial foam volume and the foam volume after 30 seconds and 120 seconds. At least two tests producing equivalent results were performed in different test tubes for the same surfactant solution.

1.2.3) Expression of Results

The foam volume results observed in the graduated test tube initially and at 30 seconds and at 120 seconds are expressed in $cm^3$. They are recorded in the following tables:

TABLE 2

Foaming power at 20° C.

| | | Composition | | | | |
|---|---|---|---|---|---|---|
| | | ($X_0$) | ($X_1$) | ($X_2$) | ($X_3$) | ($X_4$) |
| Foam volume (in $cm^3$) | At t = 0 | 100 | 65 | 120 | 125 | 50 |
| | At t = 30 s | 5 | 5 | 90 | 110 | 0 |
| | At t = 120 s | 0 | 0 | 50 | 100 | 0 |

TABLE 3

Foaming power at 60° C.

| | | Composition | | | | |
|---|---|---|---|---|---|---|
| | | ($X_0$) | ($X_1$) | ($X_2$) | ($X_3$) | ($X_4$) |
| Foam volume (in $cm^3$) | At t = 0 | 10 | 30 | 70 | 140 | 20 |
| | At t = 30 s | 5 | 1 | 30 | 120 | 0 |
| | At t = 120 s | 0 | 0 | 10 | 110 | 0 |

1.2.4) Analysis of Results

The composition ($X_0$) is characterised by the generation of highly unstable foam at 20° C., since the foam volume decreases in 30 seconds by 95% of the initial value thereof, as opposed to 92.3% for the composition ($X_1$), 25% for the composition ($X_2$) and 12% for the composition ($X_3$).

At 60° C., the n-heptylpolyglucoside composition ($X_0$) is also characterised by highly unstable foam generation since the foam volume decreases in 30 seconds by 100% of the initial value thereof, as opposed to 57.1% for the composition ($X_2$) and 14% for the composition ($X_3$). At 60° C., the composition ($X_0$) is characterised by the generation of a lower foam volume than that generated in the compositions according to the prior art.

1.3) Evaluation of Solubilising Properties of n-Heptylpolyglucosides in Acidic Media The solubilising properties in acidic media of the composition ($X_0$) were evaluated in comparison to the compositions ($X_1$), ($X_2$), ($X_3$) and ($X_4$) according to the prior art as described above according to the evaluation method described below for a non-ionic surfactant according to formula (II), in the presence of various acidic agents and at various concentrations of said acidic agents.

1.3.1) Principle of Method for Evaluating the Solubilising Power in Acidic Media The purpose of this method is to determine the solubilising power of a surfactant composition in an acidic medium for a non-ionic surfactant that is insoluble in acidic media compared to surfactant compositions according to the prior art.

1.3.2) Experimental Protocol

Into a 200 $cm^3$ glass flask, a quantity of 5 g in dry matter of a non-ionic surfactant (Ti) to be solubilised is introduced, along with a quantity of $y_1$ grams of acidic agent so as to obtain the sought dry matter concentration of said acidic agent and a quantity of additional distilled water so as to obtain a 100 $cm^3$ solution. A bar magnet is introduced into the glass flask which is then placed under magnetic stirring at a speed of 100 rpm for a time of 3 minutes at a temperature of 20° C. The solubilising surfactant composition (Xi) under test is then introduced gradually so as to obtain a clear visual appearance for the medium contained in the glass flask.

1.3.3) Expression of Results

When the visual appearance of the solution contained in the glass flask is clear, the investigator notes the quantity (in grams) of the solubilising composition (Xi) added required to obtain the clear appearance, and converts this value by means of calculation into the quantity $x_1$ (in grams) of dry matter of the solubilising agent contained in the composition (Xi).

1.3.4) Characterisation of Solubilising Power in Phosphoric Acid Medium of compositions ($X_0$) ($X_1$), ($X_2$), ($X_3$) and ($X_4$)

The experimental protocol described in paragraph 1.3.2) above is used for each of the compositions ($X_0$) ($X_1$), ($X_2$), ($X_3$) and ($X_4$), with the composition of polyethoxylated alcohols ($T_1$), prepared by means of the reaction between one molar equivalent of a mixture of alcohols comprising, per 100% by mass, 85% by mass of n-decanol and 15% by mass of n-dodecanol with 4 molar equivalents of ethylene oxide in the presence of potash as a basic catalyst. The experimental measurements were made in the presence of various quantities $y_1$ of phosphoric acid in 85% by mass solution, so as to obtain mass contents of 10% and 30% phosphoric acid in dry matter. The quantities $x_i$ of the various solubilising compositions ($X_0$), ($X_1$), ($X_2$), ($X_3$) and ($X_4$) added required to obtain a clear solution were recorded by the investigator in each case and noted in table 4 for a 10% phosphoric acid concentration and in table 5 for a 30% phosphoric acid concentration.

TABLE 4

(Phosphoric acid content: 10%)

| Composition | $x_i$ |
|---|---|
| ($X_0$) | 1.37 g |
| ($X_1$) | 1.83 g |
| ($X_2$) | 1.99 g |
| ($X_3$) | 2.43 g |
| ($X_4$) | 1.42 g |

TABLE 5

(Phosphoric acid content: 30%)

| Composition | $x_i$ |
|---|---|
| ($X_0$) | 0.42 g |
| ($X_1$) | 0.45 g |
| ($X_2$) | 0.55 g |
| ($X_3$) | 0.69 g |
| ($X_4$) | 0.73 g |

1.3.5) Characterisation of Solubilising Power in Nitric Acid Medium of Compositions ($X_0$) ($X_1$), ($X_2$) ($X_3$) and ($X_4$)

The experimental protocol described in paragraph 1.3.2) above is used for each of the compositions ($X_0$) ($X_1$), ($X_2$), ($X_3$) and ($X_4$), with the composition of polyethoxylated alcohols ($T_1$). The experimental measurements were made in the presence of various quantities $y_1$ of nitric acid in 65% by mass solution, so as to obtain mass contents of 10% and 20% nitric acid in dry matter. The quantities $x_i$ of the various solubilising compositions ($X_0$), ($X_1$), ($X_2$), ($X_3$) and ($X_4$) required to obtain a clear solution, were recorded by the investigator in each case and noted in table 6 for a 10% nitric acid concentration and in table 7 for a 20% nitric acid concentration.

TABLE 6

(Nitric acid content: 10%)

| Composition | $x_i$ |
|---|---|
| ($X_0$) | 0.76 g |
| ($X_1$) | 2.17 g |
| ($X_2$) | 1.13 g |
| ($X_3$) | 1.23 g |
| ($X_4$) | 1.72 g |

TABLE 7

(Nitric acid content: 20%)

| Composition | $x_i$ |
|---|---|
| ($X_0$) | 0.92 g |
| ($X_1$) | 1.14 g |
| ($X_2$) | 1.38 g |
| ($X_3$) | 0.95 g |
| ($X_4$) | 1.71 g |

1.3.6) Characterisation of Solubilising Power in Citric Acid Medium of Compositions ($X_0$), ($X_1$), ($X_2$), ($X_3$) and ($X_4$)

The experimental protocol described in paragraph 1.3.2) above is used for each of the compositions ($X_0$) ($X_1$), ($X_2$), ($X_3$) and ($X_4$), with the composition of polyethoxylated alcohols ($T_1$). The experimental measurements were made with a mass content of 10% citric acid in dry matter. The quantities $x_i$ of the various solubilising compositions ($X_0$), ($X_1$), ($X_2$), ($X_3$) and ($X_4$) required to obtain a clear solution were recorded by the investigator in each case and noted in table 8.

TABLE 8

(Citric acid content: 10%)

| Composition | $x_i$ |
|---|---|
| ($X_0$) | 0.93 |
| ($X_1$) | 1.14 |
| ($X_2$) | 0.93 |
| ($X_3$) | 0.95 |
| ($X_4$) | 0.74 |

1.3.7) Analysis of Results Obtained

The comparison between the solubilising performances observed for the compositions characterised by a low foaming power, i.e. the compositions ($X_0$), ($X_1$) and ($X_4$), demonstrates that, for a quantity of 10% by mass of phosphoric acid, a quantity of 1.37 g of the composition ($X_0$) is required to solubilised 5 g of the non-ionic surfactant composition ($T_1$), whereas 1.83 g of the composition ($X_1$) and 1.42 g of the composition ($X_4$) are required to obtain the same result.

Similarly, in the presence of a quantity of 10% by mass of nitric acid, a quantity of 0.76 g of the composition ($X_0$) is required to solubilise 5 g of the non-ionic surfactant composition ($T_1$), whereas 2.17 g of the composition ($X_1$) and 1.72 g of the composition ($X_4$) are required to obtain the same result, respectively equivalent to quantities by mass which are 185% and 126% greater than those used for the composition ($X_0$).

The comparison between the solubilising performances observed for the compositions ($X_0$) and ($X_2$) demonstrates that, for a quantity of 10% by mass of phosphoric acid, a quantity of 1.37 g of the composition ($X_0$) is required to solubilise 5 g of the non-ionic surfactant composition ($T_1$), whereas a quantity of 1.99 g of the composition ($X_2$) is required to obtain the same result, i.e. a quantity by mass which is 45.2% greater than that used for the composition (X0).

Similarly, in the presence of a quantity of 10% by mass of nitric acid, a quantity of 0.76 g of the composition ($X_0$) is required to solubilise 5 g of the non-ionic surfactant composition ($T_1$), whereas 1.13 g of the composition ($X_2$) is required to obtain the same result, i.e. a quantity by mass which is 48.6% greater than that used for the composition ($X_0$).

1.4 Conclusions

The composition ($X_0$) comprising n-heptylpolyglucosides, characterised by low-foam properties and environmental properties in compliance with regulatory changes, exhibits enhanced solubilising properties in acidic media compared to the solubilising agents known in the prior art.

2) Examples of Aqueous Acidic Cleaning Compositions 2.1) Metal Surface Stripper 2.1.1) Formula

| Ingredients | Mass content |
|---|---|
| Composition ($T_1$) | 5% |
| Composition ($X_0$) | 1% |
| 75% phosphoric acid | 40% |
| HORDAPHOS MDGB[1] 1% | 1% |
| Di Propylene Glycol Methyl Ether | 5% |
| Water | Up to 100% |

[1]HORDAPHOS ™MDGB: phosphoric ester marketed by CLARIANT as a corrosion inhibitor agent 2.1.2) Preparation of Acidic Cleaning and Stripping Composition Each ingredient is introduced successively into a mixing tank with moderate mechanical stirring, at ambient temperature, until a homogeneous and clear composition is obtained. Stirring is maintained for 30 minutes at 20° C. The composition obtained has a measured pH less than 1 and is clear and homogeneous after storage for a period of one month at 40° C.

2.1.3) Cleaning Method Using the Composition According to the Invention

The composition prepared in the previous paragraph is diluted to 3% in water and the solution obtained is poured into a vessel of a suitable size. The metal parts are soaked therein for 30 minutes, and then rinsed with water.

2.2. Aluminium Surface Cleaner 2.2.1) Formula

| Ingredients | Mass content |
|---|---|
| SIMULSOL ™ OX 1309 L[2] | 3% |
| Composition ($X_0$) | 3% |
| 75% phosphoric acid | 40% |
| HORDAPHOS MDGB 1% | 5% |

-continued

| Ingredients | Mass content |
|---|---|
| Di Propylene Glycol Methyl Ether | 5% |
| Water | Up to 100% |

[2]SIMULSOL ™ OX1309L: detergent surfactant composition marketed by SEPPIC, comprising polyethoxylated alcohols resulting from the reaction of one molar equivalent of an alcohol marketed under the brand name EXXAL ™13 with 9 molar equivalents of ethylene oxide.

2.2.2) Preparation of Aluminium Surface Cleaning Composition

Each ingredient is introduced successively into a mixing tank with moderate mechanical stirring, at ambient temperature, until a homogeneous and clear composition is obtained. Stirring is maintained for 30 minutes at 20° C. The composition obtained has a measured pH less than 1.0 and is clear and homogeneous after storage for a period of one month at 40° C.

2.2.3) Cleaning Method Using the Composition According to the Invention

The composition prepared in the previous paragraph is diluted to 3% in water and the solution obtained is sprayed onto the aluminium wall to be cleaned. This wall is then rinsed with hot water at 60° C.

2.3. Industrial Dishwasher Rinsing Product 2.3.1) Formulation

| Ingredients | Mass content |
|---|---|
| SIMULSOL ™ NW 900[3] | 15% |
| Composition ($X_0$) | 5% |
| Anhydrous citric acid | 17% |
| Isopropanol | 20% |
| Water | Up to 100% |

[3]SIMULSOL ™ NW 900: detergent surfactant composition marketed by SEPPIC, comprising polyethoxylated alcohols resulting from the reaction of one molar equivalent of an alcohol marketed under the brand name EXXAL ™10 with 9 molar equivalents of ethylene oxide.

2.3.2) Preparation of Acidic Industrial Dishwasher Cleaning Composition

Each ingredient is introduced successively into a mixing tank with moderate mechanical stirring, at ambient temperature, until a homogeneous and clear composition is obtained. Stirring is maintained for 30 minutes at 20° C. The composition obtained has a measured pH less than a value of 1.3 and is clear and homogeneous after storage for a period of one month at 40° C.

2.2.3) Cleaning Method Using the Composition According to the Invention

The composition prepared in the previous paragraph is diluted to 0.3% in water and the solution obtained is poured into the dishwasher and used at a temperature of 60° C.

The invention claimed is:

1. An aqueous acidic composition comprising:

a composition (C) represented by formula (I):

$$R_1—O-(G)_p-H \quad (I)$$

wherein G is a reducing sugar residue, $R_1$ is a heptyl radical, p is a decimal number greater than or equal to 1, and less than or equal to 5, said composition (C) consisting of a mixture of compounds represented by the formulae ($I_1$), ($I_2$), ($I_3$), ($I_4$) and ($I_5$):

$$R_1—O-(G)_1-H \quad (I_1)$$

$$R_1—O-(G)_2-H \quad (I_2)$$

$$R_1—O-(G)_3-H \quad (I_3)$$

$R_1$—O-$(G)_4$-H (I$_4$)

$R_1$—O-$(G)_5$-H (I$_5$), in the following respective molar proportions:

$a_1$ for the compound according to formula ($I_1$), $a_2$ for the compound according to formula ($I_2$), $a_3$ for the compound according to formula ($I_3$), $a_4$ for the compound according to formula ($I_4$) and $a_5$ for the compound according to formula ($I_5$) such that:

the sum $a_1+a_2+a_3+a_4+a_5$ is equal to 1 and that the sum $a_1+2a_2+3a_3+4a_4+5a_5$ is equal to p, said composition (C) being an agent for solubilising at least one non-ionic surfactant in said aqeuous acidic composition according to formula (II):

$$R—(O—CH(R')—CH_2)_n—(O—CH_2—CH_2)_m—O—H \quad (II)$$

wherein R is a saturated or unsaturated, linear or branched, hydrocarbon aliphatic radical, comprising from 8 to 14 carbon atoms, R' is a methyl or ethyl radical, n is an integer greater than or equal to 0 and less than or equal to 15, m is an integer greater than or equal to 0 and less than or equal to 15, it being understood that the sum n+m is greater than zero, wherein said aqeuous acidic composition has pH of less than or equal to 7.0.

2. The composition as defined in claim 1, wherein in formula (I), p is a decimal number greater than or equal to 1.05 and less than or equal to 2.5.

3. The composition as defined in claim 1 wherein, in formula (I), G is a reducing sugar residue selected from the group consisting of glucose, xylose and arabinose.

4. The composition as defined in claim 1 wherein, in formula (II), the radical R is a radical selected from the group consisting of: octyl, decyl, dodecyl, tetradecyl, 2-ethyl hexyl, 2-butyl octyl, 2-butyl decyl, 2-hexyl octyl, isooctyl, isononyl, isodecyl, isoundecyl, isododecyl, isotridecyl, isotetradecyl and 2-propyl heptyl.

5. The composition as defined in claim 1 wherein, in formula (II), n is an integer greater than or equal to 0 and less than or equal to 6.

6. The composition as defined in claim 1 wherein, in formula (II), m is an integer greater than or equal to 1 and less than or equal to 9.

7. The composition as defined in claim 1 wherein the mass ratio between said non-ionic surfactant according to formula (II) and said composition (C) is less than or equal to 15:1 and greater than or equal to 1:1.

8. A compostion ($C_1$) comprising per 100% by mass:

a) 0.2% to 40% by mass of a composition (C) represented by formula (I):

$$R_1—O-(G)_p-H \quad (I)$$

wherein G is a reducing sugar residue, $R_1$ is a heptyl radical, p is a decimal number greater than or equal to 1, and less than or equal to 5, said composition (C) consisting of a mixture of compounds represented by the formulae ($I_1$), ($I_2$), ($I_3$), ($I_4$) and ($I_5$):

$R_1$—O-$(G)_1$-H (I$_1$)

$R_1$—O-$(G)_2$-H (I$_2$)

$R_1$—O-$(G)_3$-H (I$_3$)

$R_1$—O-$(G)_4$-H (I$_4$)

$R_1$—O-$(G)_5$-H (I$_5$), in the following respective molar proportions:

$a_l$ for the compound according to formula ($I_1$), $a_2$ for the compound according to formula (1$_2$), $a_3$ for the compound according to formula ($I_3$), $a_4$ for the compound according to formula ($I_4$) and $a_5$ for the compound according to formula ($I_5$) such that:

the sum $a_1+a_2+a_3+a_4+a_5$ is equal to 1 and that the sum $a_1+2a_2+3a_3+4a_4+5a_5$ is equal to p, b) 0.2% to 80% by mass of at least one non-ionic surfactant according to formula (II):

$$R—(O—CH(R')—CH_2)_n—(O—CH_2—CH_2)_m—O—H \quad (II)$$

wherein the radical R is a saturated or unsaturated, linear or branched, hydrocarbon aliphatic radical, comprising from 8 to 14 carbon atoms, R' is a methyl or propyl radical, n is an integer greater than or equal to 0 and less than or equal to 15, m is an integer greater than or equal to 0 and less than or equal to 15, it being understood that the sum n+m is greater than zero;

c) 1% to 50% by mass of at least one acidic agent chosen from the elements of the group consisting of mineral acids and organic acids; and d) 1% to 98.6% by mass of water, wherein said composition ($C_1$) has a pH less than or equal to 7.0.

9. The composition ($C_1$) as defined in claim 8, wherein the mass ratio between the compound according to formula (II) and said composition (C) is less than or equal to 15:1 and greater than or equal to 1:1.

10. A method for cleaning hard surfaces, comprising applying to said surface the composition ($C_1$) as defined in claim 8.

11. A method for cleaning a hard surface, comprising:

at least one step $a_1$) for applying the composition ($C_1$) as defined in claim 8 onto said hard surface, followed by at least one step $b_1$) for rinsing said hard surface.

12. A method of solubilising at least one non-ionic surfactant in an aqueous acidic composition, comprising adding a composition (C) represented by formula (I):

$$R_1—O-(G)_p-H \quad (I)$$

wherein G is a reducing sugar residue, $R_1$ is a heptyl radical, p is a decimal number greater than or equal to 1, and less than or equal to 5, said composition (C) consisting of a mixture of compounds represented by the formulae ($I_1$), ($I_2$), ($I_3$), ($I_4$) and ($I_5$):

$R_1$—O-$(G)_1$-H (I$_1$)

$R_1$—O-$(G)_2$-H (I$_2$)

$R_1$—O-$(G)_3$-H (I$_3$)

$R_1$—O-$(G)_4$-H (I$_4$)

$R_1$—O-$(G)_5$-H (I$_5$), in the following respective molar proportions:

$a_1$ for the compound according to formula ($I_1$), $a_2$ for the compound according to formula ($I_2$), $a_3$ for the compound according to formula ($I_3$), $a_4$ for the compound according to formula ($I_4$) and $a_5$ for the compound according to formula ($I_5$) such that:

the sum $a_1+a_2+a_3+a_4+a_5$ is equal to 1 and that the sum $a_1+2a_2+3a_3+4a_4+5a_5$ is equal to p, to an aqueous acid composition comprising at least one non-ionic surfactant according to formula (II):

$$R—(O—CH(R')—CH_2)_n—(—CH_2—CH_2)_m—O—H \quad (II)$$

wherein R is a saturated or unsaturated, linear or branched, hydrocarbon aliphatic radical, comprising from 8 to 14 carbon atoms, R' is a methyl or ethyl radical, n is an integer greater than or equal to 0 and less than or equal to 15, m is an integer greater than or equal to 0 and less than or equal to 15, it being understood that the sum n+m is greater than zero.

13. The method according to claim 12, wherein, in formula (I), p is a decimal number greater than or equal to 1.05 and less than or equal to 2.5.

14. The method according to claim 12, wherein, in formula (I), G is a reducing sugar residue selected from the group consisting of glucose, xylose and arabinose residues.

15. The method according to claim 12, wherein, in formula (II), the radical R is a radical selected from the group consisting of octyl, decyl, dodecyl, tetradecyl, 2-ethyl hexyl, 2-butyl octyl, 2-butyl decyl, 2-hexyl octyl, isooctyl, isononyl, isodecyl, isoundecyl, isododecyl, isotridecyl, isotetradecyl and 2-propyl heptyl.

16. The method according to claim 12, wherein, in formula (II), n is an integer greater than or equal to 0 and less than or equal to 6.

17. The method according to claim 12, wherein, in formula (II), m is an integer greater than or equal to 1 and less than or equal to 9.

18. The method according to claim 12, wherein the mass ratio between said non-ionic surfactant according to formula (II) and said composition (C) is less than or equal to 15:1 and greater than or equal to 1:1.

* * * * *